US006209462B1

(12) United States Patent
Theurer

(10) Patent No.: US 6,209,462 B1
(45) Date of Patent: Apr. 3, 2001

(54) MACHINE WITH BALLAST SCARIFYING DEVICE

(75) Inventor: Josef Theurer, Vienna (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/264,805

(22) Filed: Mar. 9, 1999

(30) Foreign Application Priority Data

Apr. 1, 1998 (AT) ..... 571/98

(51) Int. Cl.[7] ..... E01B 29/06
(52) U.S. Cl. ..... 104/9; 104/2; 37/104
(58) Field of Search ..... 104/2, 9; 171/16; 37/104

(56) References Cited

U.S. PATENT DOCUMENTS 3,850,251 * 11/1974 Plasser et al. ..... 171/16
4,611,541 9/1986 Theurer .
5,094,018 * 3/1992 Theurer et al. ..... 37/104
5,125,345 6/1992 Theurer et al. .
5,513,452 5/1996 Theurer et al. .

FOREIGN PATENT DOCUMENTS 1 116 257 11/1961 (DE) .
2 588 023 4/1987 (FR) .

* cited by examiner

*Primary Examiner*—S. Joseph Morano
*Assistant Examiner*—Andrew D. Wright
(74) *Attorney, Agent, or Firm*—Collard & Roe, P.C.

(57) ABSTRACT

A crib ballast clearing machine comprises a machine frame supported on undercarriages adapted to support the machine frame on a track comprised of rails fastened to ties defining cribs therebetween, and a ballast scarifying device comprising a revolvable endless excavating chain vertically adjustably mounted on the machine frame for removing ballast from a respective one of the cribs between the rails, a drive for revolving the endless excavating chain, and a displacement drive for vertically adjusting the endless excavating chain. The endless excavating chain has a lowermost ballast receiving part being immersible in ballast in the crib between the rails upon vertical adjustment of the endless excavating chain.

4 Claims, 1 Drawing Sheet

MACHINE WITH BALLAST SCARIFYING DEVICE

BACKGROUND OF THE INVENTION

1. Field of the Invention

The present invention relates to a machine comprising a machine frame supported on undercarriages adapted to support the machine frame on a track comprised of rails fastened to ties defining cribs therebetween, and a ballast scarifying device for removing ballast from a respective one of the cribs between the rails.

2. Description of the Prior Art

U.S. Pat. No. 5,125,345 discloses a tie exchange machine in which a ballast scarifying device is arranged to remove ballast from a crib adjacent the tie to be exchanged. The ballast scarifying device is comprised of four ballast clearing plates spaced from each other in a direction extending transversely to the machine frame. Pairs of the ballast clearing plates may be independently displaced in a transverse direction towards a respective one of the track shoulders. This transverse displacement will remove the ballast from the crib towards the track shoulders.

French patent No. 2,588,023 and German patent No. 1,116,257 disclose machines with endless bucket chains for clearing ballast from a track bed. The bucket chain is lowered into the ballast between the track rails to excavate the ballast and convey it upwards to a conveyor band. Before the bucket chain is immersed in the ballast, the track ties must be removed.

U.S. Pat. No. 4,611,541 discloses a ballast cleaning machine in which an endless ballast excavating chain is mounted between two tie exchange devices to remove the entire ballast of the track bed and to convey it to a cleaning screen.

U.S. Pat. No. 5,513,452 also deals with an installation for the rehabilitation of a ballast bed. A first ballast excavating device is arranged at the front of the installation for receiving clean ballast deposited on the track, and this clean ballast is conveyed behind a second ballast excavating device which clears the dirty ballast to expose the subgrade. The dirty ballast is cleaned and returned to the exposed subgrade where the clean ballast conveyed from the first ballast excavating device is used to supplement the cleaned ballast.

SUMMARY OF THE INVENTION

It is the primary object of this invention to improve a machine of the first described type so that a tie exchange operation may be facilitated with a better ballast scarifying device.

In such a machine, this object is accomplished according to the invention with a ballast scarifying device comprising a revolvable endless excavating chain vertically adjustably mounted on the machine frame for removing ballast from a respective one of the cribs between the rails, a drive for revolving the endless excavating chain, and a displacement drive for vertically adjusting the endless excavating chain. The endless excavating chain has a lowermost ballast receiving part being immersible in ballast in the crib between the rails upon vertical adjustment of the endless excavating chain.

Such an excavating chain makes it possible to clear substantially all the ballast in the crib between the rails. Moreover, it has the advantage to enable the cleared ballast to be completely removed from the track by the chain for immediate storage. Therefore, a new tie may be readily inserted without any obstacles in its way, and the full tie inserting movement under the second rail in the inserting direction is not hindered by jammed ballast.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF PREFERRED EMBODIMENT

Figure 1:
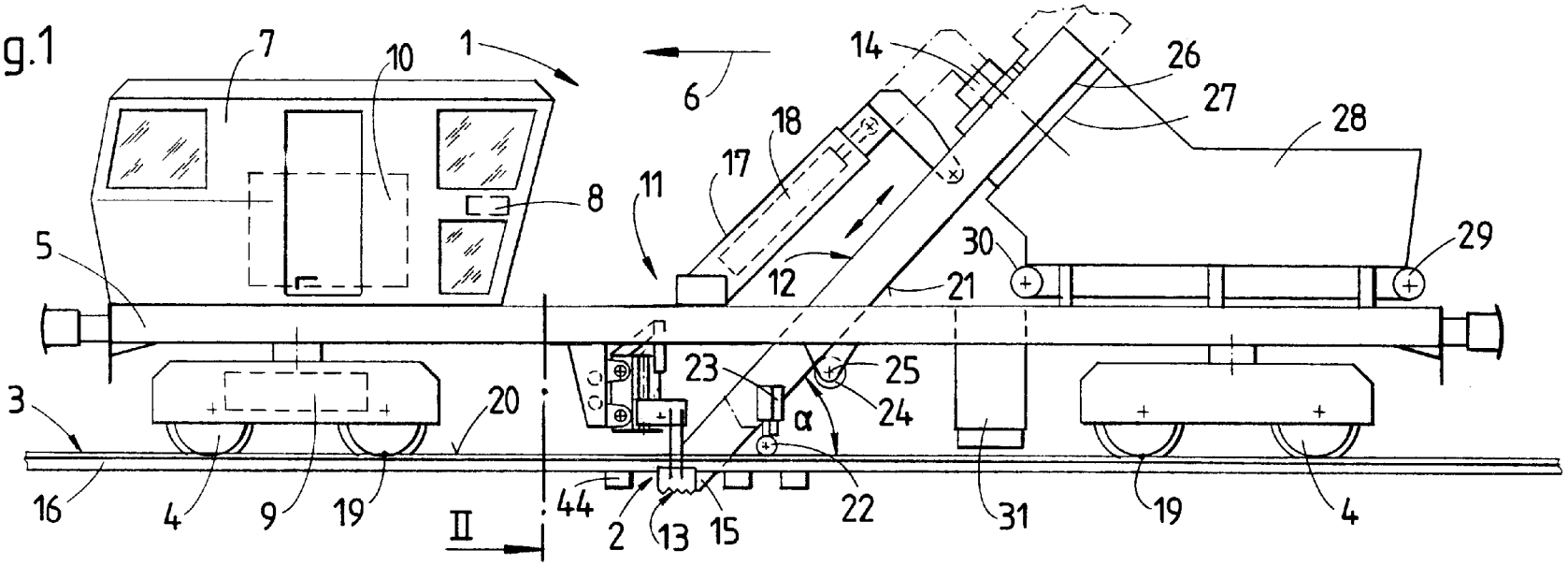
FIG. 1 is a side elevational view of a machine according to this invention.

As shown in FIG. 1, machine 1 for clearing ballast from a crib comprises machine frame 5 supported on undercarriages 4, 4 adapted to support the machine frame on track 3 comprised of rails 16 fastened to ties 44 defining cribs 2 therebetween. Cab 7 is mounted on a front end of the machine frame, in the operating direction indicated by arrow 6, and central control 8 is arranged in the cab, which also holds power plant 10 for the various drives of the machine to be described hereinafter, including drive 9 for moving machine 1 along track 3.

Ballast scarifying device 11 is mounted on machine frame 5 between undercarriages 4, 4. The ballast scarifying device comprises revolvable endless excavating chain 12 for removing ballast from a respective one of cribs 2 between rails 16, and ballast clearing plate 13. Endless excavating chain 12 is vertically adjustably mounted on machine frame 5 and comprises drive 14 for revolving the endless excavating chain. The endless excavating chain has a lowermost ballast receiving part 15 facing track 3 and immersible in ballast in crib 2 between rails 16 upon vertical adjustment of endless excavating chain 12. For this purpose, displacement drive 18 for vertically adjusting the endless excavating chain is mounted in telescopingly extensible carrier arm 17 affixed to machine frame 5.

Points of contact 19 between track rails 16 and wheels on undercarriages 4, 4 define running plane 20 extending in a longitudinal direction along track 3, and endless excavating chain 12 is arranged to revolve and to be vertically adjusted in plane 21 extending transversely to the longitudinal direction and at an acute angle $\alpha$ to the running plane. The angle is preferably between 40° and 50°.

In the illustrated embodiment, the ballast scarifying device further comprises flanged rollers 22 transversely spaced from each other and supporting endless excavating chain 12 on track rails 16. The flanged rollers are adjustably positionable in plane 21 in which the endless excavating chain is arranged, for which purpose they are connected to vertical adjustment drive 23 connecting flanged rollers 22 to endless excavating chain 12. Furthermore, transversely spaced support rollers 24 affixed to machine frame 5 are arranged for additional support and guidance of endless excavating chain 12. Support rollers 24 are freely rotatable about horizontal axis 25 extending in a transverse direction.

As endless excavating chain 12 is revolved, it conveys the ballast scooped up by lowermost ballast receiving part 15 to opposite end 26 of the endless excavating chain, where the ballast is discharged into opening 27 of a ballast storage bin 28 mounted on machine frame 5. The bottom of the storage bin is constituted by conveyor band 29 extending in the longitudinal direction of the machine frame, and this conveyor band has a discharge end 30 above discharge chutes 31 so that the excavated ballast may be returned to the track bed.

Figure 2:
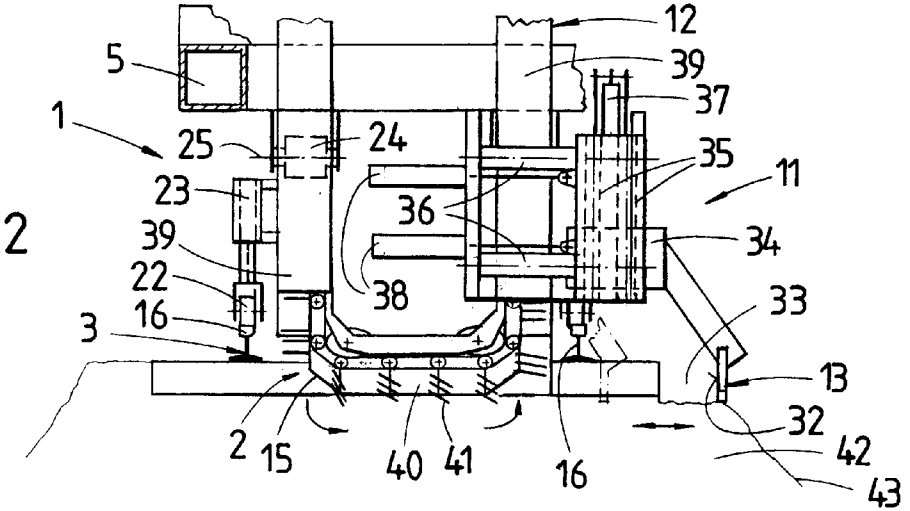
FIG. 2 is an enlarged fragmentary end view of the ballast scarifying device, taken in the direction of arrow II of FIG. 1.

As best shown in FIG. 2, ballast scarifying device 11 further comprises ballast clearing plate 13 arranged in vertical plane 32 extending in a longitudinal direction along track 3 and positioned in track shoulder 33. Ballast cleaning plate 13 is affixed to tool carrier 34 mounted on vertically and transversely extending guides 35, 36. Drives 37, 38 are connected to tool carrier 34 for independently displacing the ballast clearing plate in a vertical and transverse direction.

The specific construction of revolvable endless ballast excavating chain 12 is generally the same as in conventional ballast cleaning machines widely used in track maintenance and rehabilition, and it has been schematically illustrated at lowermost ballast receiving part 15. The chain is comprised of a multiplicity of chain links 40 and, outside the lowermost ballast receiving part, it runs in trough-shaped guide members 39 carried on machine frame 5 by rollers 24 and carrier arm 17. Each chain link 40 carries scraping fingers 41 which engage the ballast in crib 2 and remove it from the crib as the chain revolves. This removed ballast is then conveyed in an upwardly extending trough-shaped guide member 39 to discharge end 26, and the revolving chain returns empty in a downwardly extending trough-shaped guide member.

Machine 1 is operated in the following manner:

The machine is driven in the operating direction indicated by arrow 6 to the site of crib 2 to be cleared of ballast after an adjacent tie has been removed in a manner not further described or illustrated. To clear the ballast from shoulder 33 adjacent crib 2, drive 37 is actuated to lower ballast clearing plate 13 until it is immersed in shoulder ballast 42 immediately adjacent rail 16 of track 3, as shown in phantom lines in FIG. 2. Drive 38 is then actuated to displace clearing plate 13 transversely outwardly to remove the ballast from shoulder region 33 to shoulder embankment 43. Crib ballast between track rails 16 is then cleared by actuating displacement drive 18 to displace endless balance excavating chain 12 from a raised transit position, shown in phantom lines in FIG. 1, to an operating position, shown in full lines, in which lowermost chain part 15 is immersed in ballast in crib 2 between rails 16. At the same time, drive 14 is actuated to revolve the endless ballast excavating chain in the direction indicated by small arrows in FIG. 2 so that the lowermost chain part may clear the ballast in the crib. By actuating drives 23 to adjust the vertical distance of flanged rollers 22 from the endless ballast excavating chain, the depth of immersion of lowermost excavating chain part 15 in the ballast may be controlled. The ballast removed from crib 22 is discharged from end 26 into intermediate storage bin 28. Bottom conveyor band 29 is driven so that the ballast may be discharged to the track bed from the storage bin at selected sites through discharge chutes 31.

To enable the cribs to be cleared accurately of ballast, machine 1 is advanced just a little in the operating direction, i.e. just before tie 44 adjacent to cleared crib 2. By displacing ballast excavating chain 12 into the raised transit position, machine 1 may be advanced to the next crib to be cleared. All the operating drives of the machine are actuated by control 8 in operator's cab 7. The subsequent insertion of new ties in cleared cribs 2 is effected by a tie exchange machine, independently of the operation of machine 1.

If desired, the illustrated embodiment of machine 1 may also carry devices for pulling and inserting ties, as well as devices for conveying and storing old and new ties.

Also, the flexbility of machine 1 may be enhanced if a further ballast clearing plate similar to that of ballast clearing plate 13 were installed at the opposite side of machine frame 5.

What is claimed is:

1. A machine comprising (a) a machine frame supported on undercarriages adapted to support the machine frame on a track comprised of rails fastened to ties defining cribs therebetween, and (b) a ballast scarifying device comprising (1) a revolvable endless excavating chain vertically adjustably mounted on the machine frame for removing ballast from a respective one of the cribs between the rails, (2) a drive for revolving the endless excavating chain, and (3) a displacement drive for vertically adjusting the endless excavating chain, (4) the endless excavating chain having a lowermost ballast receiving part being immersible in ballast in the crib between the rails upon vertical adjustment of the endless excavating chain, points of contact between the track rails and wheels on the undercarriages defining a running plane extending in a longitudinal direction along the track, and the endless excavating chain being arranged to revolve and to be vertically adjusted in a plane extending transversely to the longitudinal direction and at an acute angle to the running plane.

2. The machine of claim 1, wherein the ballast scarifying device further comprises flanged rollers supporting the endless excavating chain on the track rails.

3. The machine of claim 2, wherein the flanged rollers are adjustably positionable in the plane in which the endless excavating chain is arranged.

4. The machine of claim 1, wherein the ballast scarifying device further comprises a ballast clearing plate arranged in a vertical plane extending in a longitudinal direction along the track, and drive means connected thereto for independently displacing the ballast clearing plate in a vertical and transverse direction.

* * * * *